US010305206B1

(12) United States Patent
Huo et al.

(10) Patent No.: US 10,305,206 B1
(45) Date of Patent: May 28, 2019

(54) ELECTRICAL CONNECTOR

(71) Applicant: SHENZHEN DEREN ELECTRONIC CO., LTD., Shenzhen (CN)

(72) Inventors: Zhudong Huo, Shenzhen (CN); Mei Li, Shenzhen (CN)

(73) Assignee: SHENZHEN DEREN ELECTRONIC CO., LTD., Shenzhen (CN)

( * ) Notice: Subject to any disclaimer, the term of this patent is extended or adjusted under 35 U.S.C. 154(b) by 0 days.

(21) Appl. No.: 16/004,469

(22) Filed: Jun. 11, 2018

(30) Foreign Application Priority Data

Mar. 7, 2018 (CN) ..... 2018 2 0311458 U
Mar. 7, 2018 (CN) ..... 2018 2 0316767 U

(51) Int. Cl.

| | |
|---|---|
| ***H01R 12/50*** | (2011.01) |
| ***H01R 12/70*** | (2011.01) |
| ***H01R 12/71*** | (2011.01) |
| ***H01R 13/24*** | (2006.01) |
| ***H01R 13/41*** | (2006.01) |
| ***H01R 12/00*** | (2006.01) |

(52) U.S. Cl.
CPC ..... *H01R 12/716* (2013.01); *H01R 12/00* (2013.01); *H01R 13/2442* (2013.01); *H01R 13/41* (2013.01); *H01R 12/707* (2013.01); *H01R 12/7076* (2013.01)

(58) Field of Classification Search
CPC .. H01R 23/722; H01R 23/7073; H01R 9/096; H01R 13/41; H01R 13/2442; H01R 12/716; H01R 12/7076; H01R 12/707
USPC ..... 439/66, 733.1, 862
See application file for complete search history.

(56) References Cited

U.S. PATENT DOCUMENTS

| | | | | |
|---|---|---|---|---|
| 8,500,458 | B2 * | 8/2013 | Chang | H01R 13/2435 439/66 |
| 2005/0054218 | A1 * | 3/2005 | Liao | H01R 9/096 439/66 |
| 2005/0245106 | A1 * | 11/2005 | Ma | H01R 13/2442 439/66 |
| 2006/0292935 | A1 * | 12/2006 | Ma | H01R 13/2442 439/752.5 |
| 2011/0256771 | A1 * | 10/2011 | Jin | H01R 12/52 439/626 |
| 2012/0178298 | A1 * | 7/2012 | Jin | H01R 12/714 439/626 |
| 2014/0045350 | A1 * | 2/2014 | Taylor | H05K 7/10 439/66 |
| 2015/0171540 | A1 * | 6/2015 | Huang | H01R 12/52 439/722 |

* cited by examiner

*Primary Examiner* — Gary F Paumen
(74) *Attorney, Agent, or Firm* — IPro, PLLC; Na Xu

(57) ABSTRACT

An electrical connector includes an insulation body and conductive terminals. The insulation body defines receiving holes corresponding to the conductive terminals, respectively. Each receiving hole includes a first hole portion, a second hole portion and a third hole portion. Each conductive terminal includes a main part, an elastic arm, a connection part, and a holding part. Both the main part and the holding part are embedded in the second hole portion, and are obliquely positioned relative to the X axis of the insulation body. The first and third hole portions are located at two opposite sides of the main part. At least part of the elastic arm is located above the first hole portion.

20 Claims, 8 Drawing Sheets

ELECTRICAL CONNECTOR

CROSS-REFERENCE TO RELATED APPLICATIONS

The present disclosure claims priority to Chinese Patent Application No. 201820316767.9 filed with the Chinese Patent Office on Mar. 7, 2018, titled "ELECTRICAL CONNECTOR", and Chinese Patent Application No. 201820311458.2 filed with the Chinese Patent Office on Mar. 7, 2018, titled "ELECTRICAL CONNECTOR", the entire contents of which are incorporated herein by reference.

TECHNICAL FIELD

The present disclosure relates to the field of connectors, and particularly, to an electrical connector for electrically connecting a chip module to a printed circuit board.

BACKGROUND

The planar grid array electrical connectors are widely used in the electronic field for electrically connecting a chip module to a printed circuit board to realize the signal and data transmission between the chip module and the circuit board. The electrical connectors include an insulation body and a plurality of conductive terminals received in the insulation body. When the electrical connectors enable the chip module to connect to the circuit board, the contact part of the conductive terminal is pressed on the conducting strip of the chip module, and the soldering part of the conductive terminal is soldered to the conducting strip of the circuit board through a solder, to transmit signals between the chip module and the circuit board.

With the upgrading of the functions of the electronic products, the integration level of the electronic devices becomes higher and higher, and the layout of the electrical connectors is increasingly concentrated. Therefore, the conductive terminals of the electrical connectors become smaller and smaller, which greatly weakens the strength of the conductive terminals, and further reduces the elasticity of the conductive terminals. To avoid the deformation of the conductive terminals in the process of being installed into the receiving holes of the insulation body, the size of the receiving holes must be larger than the size of the conductive terminals.

SUMMARY

An embodiment of this disclosure provides an electrical connector including: an insulation body and a plurality of conductive terminals positioned in the insulation body; wherein: the insulation body defines a plurality of receiving holes corresponding to the conductive terminals, respectively; each of the receiving holes includes a first hole portion, a second hole portion and a third hole portion; first hole portions of the receiving holes are distributed in parallel along an X axis of the insulation body; for each receiving hole, the second hole portion and the third hole portion are located at two opposite sides of the first hole portion, and both communicate with the first hole portion; and the second hole portion is obliquely positioned relative to the X axis and the Y axis of the insulation body; the first hole portion includes a first front wall surface, a first side wall surface and a first rear wall surface; the second hole portion includes a second front wall surface, a second side wall surface and a second rear wall surface; and the third hole portion includes a third front wall surface, a third side wall surface and a third rear wall surface; each of the conductive terminals includes a main part, an elastic arm, a connection part and a holding part, the elastic arm is an extension of an upper part of the main part, the connection part is an extension of a lower part of the main part, and the holding part is an extension of a side part of the main part; at least part of the main part is embedded in the second hole portion, at least part of the holding part is embedded in the third hole portion, both the main part and the holding part are not parallel to the X axis and the Y axis of the insulation body; and a distance L1 between a front end of the second side wall surface and a front end of the third side wall surface is less than a distance L2 between a rear end of the second side wall surface and a rear end of the third side wall surface.

Another embodiment of this disclosure provides an electrical connector including: an insulation body and a plurality of conductive terminals positioned in the insulation body; wherein: the insulation body defines a plurality of receiving holes corresponding to the conductive terminals, respectively; each of the receiving holes includes a plurality of inner side surfaces; each of the receiving holes includes a first hole portion, a second hole portion and a third hole portion; for each receiving hole, the first hole portion and the third hole portion communicate with the second hole portion; the second hole portion includes a lateral hole portion and a horizontal hole portion, the lateral hole portion is obliquely positioned relative to the first hole portion, and the horizontal hole portion is positioned along the X axis of the insulation body; each of the conductive terminals includes a main part, an elastic arm, a connection part and a holding part, the elastic arm is an extension of an upper part of the main part, the connection part is an extension of a lower part of the main part, and the holding part is an extension of a side part of the main part; and both the main part and the holding part are embedded in the second hole portion, and are obliquely positioned relative to the X axis of the insulation body; the first hole portion and the third hole portion are located at two opposite sides of the main part, and at least part of the elastic arm is located above the first hole portion.

BRIEF DESCRIPTION OF THE DRAWINGS

One or more embodiments are exemplarily described with reference to pictures in corresponding attached drawings, and these exemplary descriptions are not intended to limit the embodiments. In the attached drawings, elements bearing the same reference numerals represent the same or similar elements, and unless otherwise stated, the pictures in the attached drawings are not intended to limit the scale.

DETAILED DESCRIPTION

Figure 1:
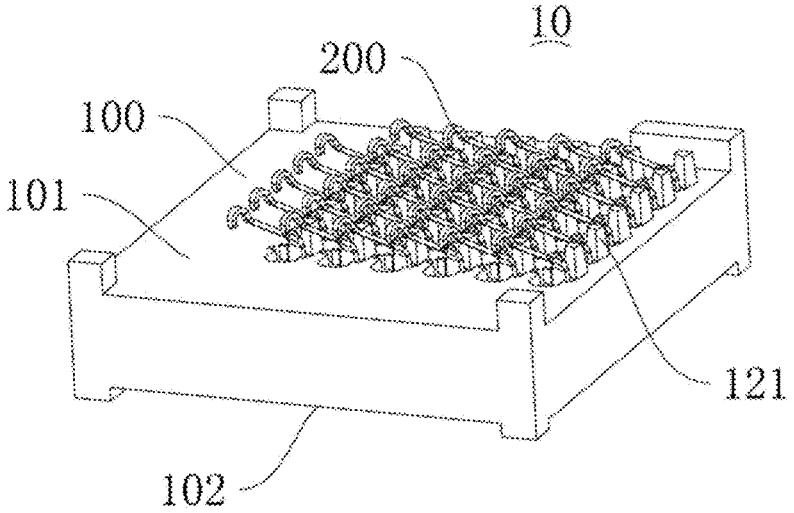
FIG. 1 is a stereogram of an electrical connector in accordance with an embodiment of the present disclosure.

An embodiment of an electrical connector for electrically connecting a chip module (not shown) to a printed circuit board (not shown) is provided. As shown in FIG. 1, the electrical connector 10 includes an insulation body 100 and a plurality of conductive terminals 200 positioned in the insulation body 100; the insulation body 100 includes an upper surface 101 and a lower surface 102 opposite to the upper surface 101; when the electrical connector 10 is connected to a chip module, the upper surface 101 is much closer to the chip module than the lower surface 102.

Figure 2:
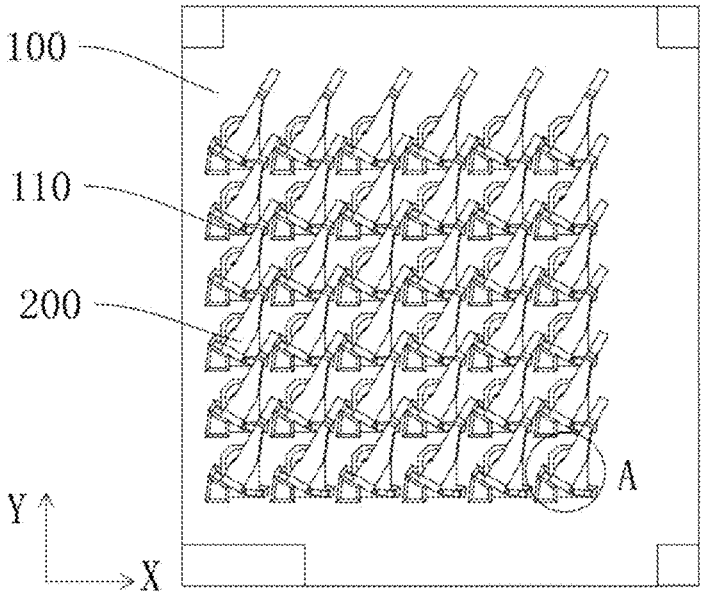
FIG. 2 is a top view of the electrical connector shown in FIG. 1.

Referring also to FIG. 2, the insulation body 100 defines a plurality of receiving holes 110; the receiving holes 110 are defined in the insulation body 100 and arranged in a grid of M rows×N columns; the rows are arranged along the X axis of the insulation body 100, and the columns are arranged along the Y axis of the insulation body 100. Each receiving hole 110 accommodates a corresponding one of the conductive terminals 200.

Figure 3:
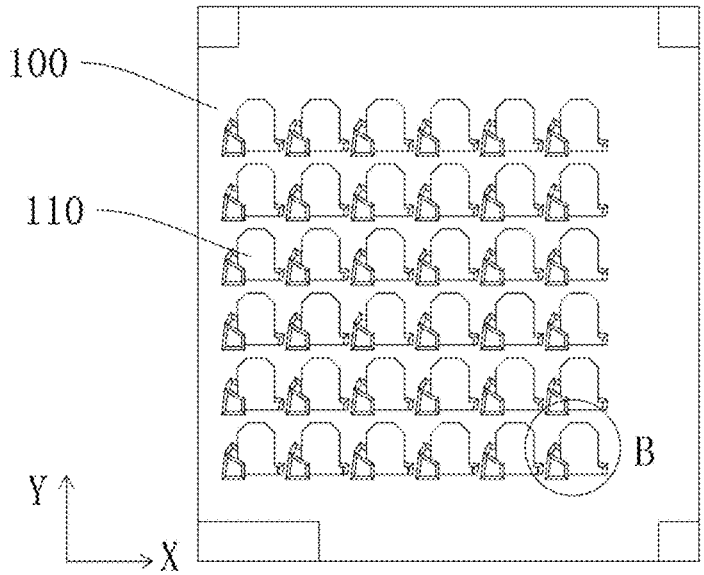
FIG. 3 is a top view of an insulation body of the electrical connector shown in FIG. 1.
Figure 4:
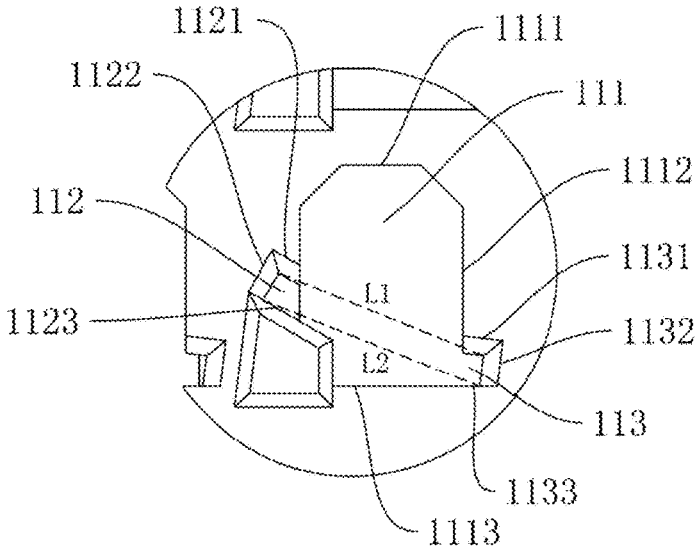
FIG. 4 is a local enlarged view of part B of the insulation body shown in FIG. 3.

Referring to FIG. 3 and FIG. 4, each of the receiving holes 110 includes a first hole portion 111, a second hole portion 112 and a third hole portion 113; first hole portions 111 are distributed in parallel along the X axis of the insulation body 100. For each receiving hole 110, the second hole portion 112 and the third hole portion 113 are located at two opposite sides of the first hole portion 111, and both communicate with the first hole portion 111; and the second hole portion 112 is obliquely positioned relative to the X axis and the Y axis of the insulation body 100.

The first hole portion 111 includes a first front wall surface 1111, a first side wall surface 1112 and a first rear wall surface 1113; the first front wall surface 1111 and the first rear wall surface 1113 are positioned oppositely; the first front wall surface 1111 and the first side wall surface 1112 are in a transition connection using chamfers or circular arcs; and the first front wall surface 1111 are disconnected to the first rear wall surface 1113. In this embodiment, the first rear wall surface 1113 is parallel to the X axis of the insulation body 100.

The second hole portion 112 includes a second front wall surface 1121, a second side wall surface 1122 and a second rear wall surface 1123; the second front wall surface 1121 and the second rear wall surface 1123 are positioned oppositely; both the second front wall surface 1121 and the second rear wall surface 1123 are connected to the second side wall surface 1122. In an embodiment, the second side wall surface 1122 is obliquely positioned relative to the X axis and the Y axis of the insulation body 100, and the second front wall surface 1121 is parallel to the second rear wall surface 1123.

The third hole portion 113 includes a third front wall surface 1131, a third side wall surface 1132 and a third rear wall surface 1133; the third front wall surface 1131 and the third rear wall surface 1133 are positioned oppositely; both the third front wall surface 1131 and the third rear wall surface 1133 are connected to the third side wall surface 1132. The third rear wall surface 1133 and the first rear wall surface 1113 share a common wall surface. The third side wall surface 1132 and the third rear wall surface 1133 form a non-right angle, either obtuse or acute angle. In an embodiment, the width of the third hole portion 113 gradually increases along the direction towards the first hole portion 111, and the third front wall surface 1131 is not parallel to the third rear wall surface 1133.

Figure 5:
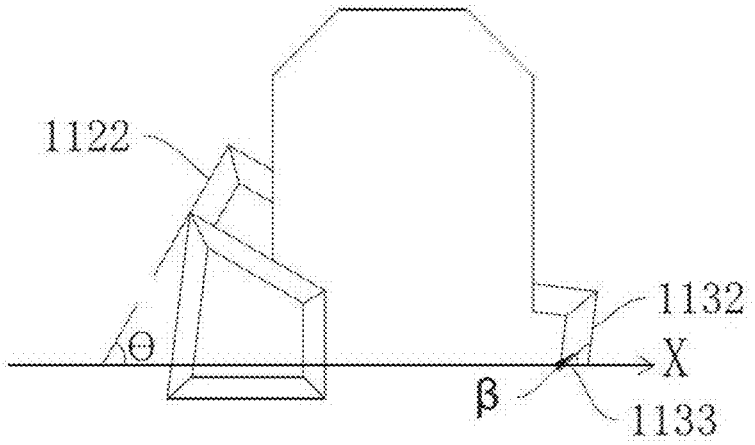
FIG. 5 is a top view of a receiving hole of the insulation body shown in FIG. 3.

In some embodiments, a distance L1 between the front end of the second side wall surface 1122 and the front end of the third side wall surface 1132 is less than a distance L2 between the rear end of the second side wall surface 1122 and the rear end of the third side wall surface 1132. In practice, as shown in FIG. 5, when the inclination angle of the second side wall surface 1122 relative to the X axis of the insulation body 100 is θ, the angle β formed by the third side wall surface 1132 and the third rear wall surface 1133 is less than (180°−θ) and unequal to 90°, so that the distance L1 is less than L2.

Figure 6:
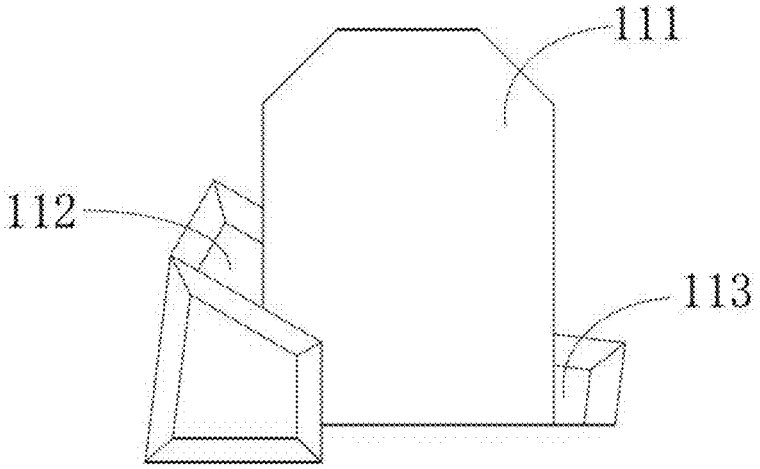
FIG. 6 is a top view of a receiving hole of an insulation body, according to another embodiment.

Moreover, in this illustrated embodiment, both of the first hole portion 111 and the third hold portion 113 are through holes, while the second hole portion 112 is a blind hole, that is, both the first hole portion 111 and the third hold portion 113 penetrate the insulation body 100, while the second hole portion 112 does not. Therefore, when the conductive terminal 200 is inserted into the insulation body 100, the second hole portion 112 can prevent the over-assembly of the conductive terminal 200 to the insulation body 100. It should be understood that, in some alternative embodiments, as shown in FIG. 6, the third hole portion 113 may be a blind hole as well, i.e., the second hole portion 112 and the third hole portion 113 are both blind holes. Both sides of the conductive terminal 200 are limited by the second hole portion 112 and the third hole portion 113, which further prevents the over-assembly of the conductive terminal 200 to the insulation body 100. In still other alternative embodiments, the second hole portion 112 can also be a through hole, i.e., the first hole portion 111 and the second hole portion 112 are both through hole and the third hole portion 113 is a blind hole or a through hole. It should be understood that each of the second hole portion 112 and the third hole portion 113 is not limited to be a through hole or a blind hole, as long as the first hole portion 111 is a through-hole.

Figure 7:
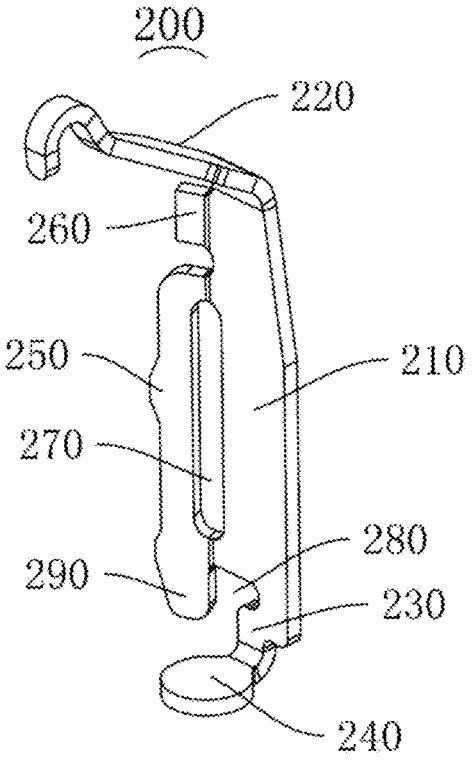
FIG. 7 is a stereogram of a conductive terminal of the electrical connector shown in FIG. 1.

As shown in FIG. 7, each of the conductive terminals 200 includes a tabulate main part 210, an elastic arm 220 and a connection part 230. The elastic arm 220 is an extension of an upper part of the main part 210. The connection part 230 is an extension of a lower part of the main part 210. The elastic arm 220 has good elasticity and extends out of the insulation body 100, the connection part 230 is connected to a welding part 240, the welding part 240 is bent at an angle of approximately ninety degrees with respect to the main part 210, so that the conductive terminal 200 is welded to a printed circuit board through a solder.

The conductive terminal 200 further includes a holding part 250 which is an extension of a side part of the main part 210; one end of the holding part 250 is a fixed end connecting the holding part 250 and the main part 210, and the other end thereof is a free end.

In some embodiments, the conductive terminal 200 further includes a solder part 260 which is an extension of the side part of the main part 210; the solder part 260 and the holding part 250 are located on the same side of the main part 210, the solder part 260 is located above the holding part 250, and is positioned in the same plane as the holding part 250.

Figure 8:
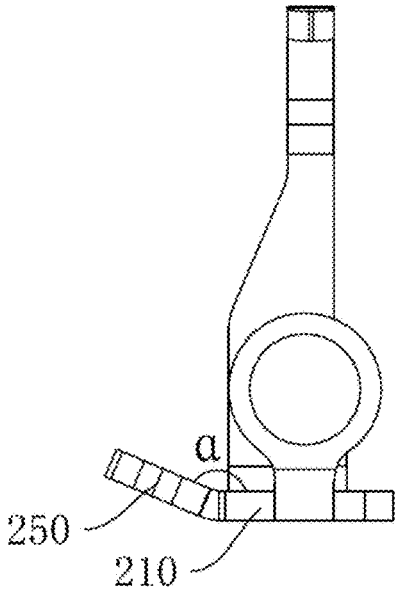
FIG. 8 is a bottom view of the conductive terminal shown in FIG. 7.

As shown in FIG. 8, an included angle $\alpha$ between the holding part 250 and the main part 210 ranges from 155° to 160°.

A deformed groove 270 is positioned between the main part 210 and the holding part 250. The deformed groove 270 is a closed structure, and at least one in number. The deformed groove 270 is compression resistant, and when the conductive terminals 200 are mounted into the receiving holes 110 of the insulation body 100, the holding part 250 is stressed to squeeze the deformed groove 270, so that the force apportioned on the main part 210 is less, the conductive terminals 200 are not easily deformed, thus reducing the defective rate of the conductive terminals 200 after the assembly.

The lower part of the connection part 230 is connected to the welding part 240, the upper part of connection part 230 and the main part 210 form a separation slot 280, and the deformed groove 270 is positioned above the separation slot 280.

In some embodiments, the lower part of the holding part 250 extends downwards to form an extension 290, which is positioned at one side of the separation slot 280. In the process of mounting the conductive terminals 200 into the insulation body 100, the extension 290 can balance the stress of the main part 210, which is conducive to securing and stabilizing the conductive terminals 200, thus reducing the defective rate after the assembly.

Figure 9:
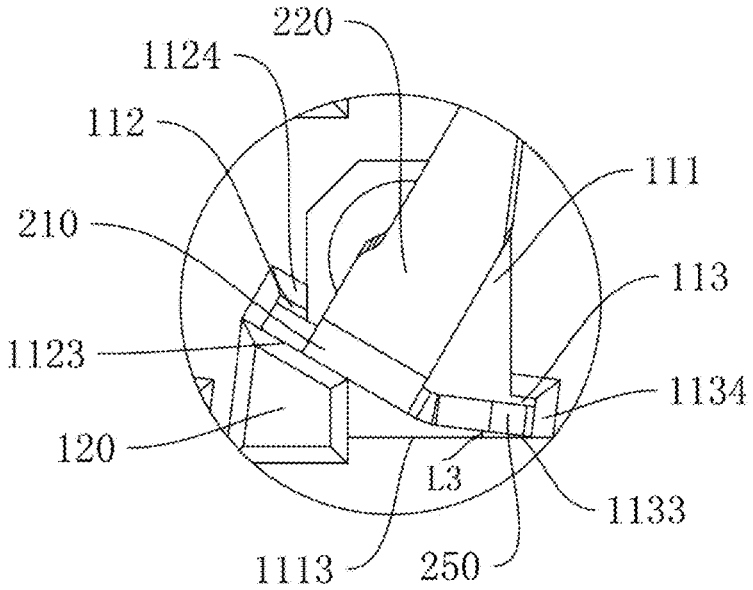
FIG. 9 is a local enlarged view of part A of the electrical connector shown in FIG. 2.

Refer to FIG. 9, after the conductive terminals 200 are inserted into the insulation body 100, at least part of the main part 210 is embedded in the second hole portion 112, at least part of the holding part 250 is embedded in the third hole portion 113, both the main part 210 and the holding part 250 are not parallel to the X axis and the Y axis of the insulation body 100, that is, the holding part 250 is not parallel to the first rear wall surface 1113 and the third rear wall surface 1133.

As an exemplary embodiment, assume the extension direction of the elastic arm 220 is considered as the forward direction, the second hole portion 112 is located on the left side of the first hole portion 111, the third holding hole 113 is located on the right side of the first hole portion 111, and the elastic arm 220 may be partially or completely located above the first hole portion 111.

When the chip module is electrically connected to the conductive terminal 200 of the electrical connector by pressing, after the elastic arm 220 of the conductive terminal 200 is stressed, because at least part of the main part 210 is embedded in the second hole portion 112, at least part of the holding part 250 is embedded in the third hole portion 113, the second hole portion 112 is obliquely positioned relative to the X axis and the Y axis of the insulation body 100, thus stably fixing the conductive terminal 200 in the insulation body 100. Meanwhile, the distance L1 between the front end of the second side wall surface 1122 and the front end of the third side wall surface 1132 is less than the distance L2 between the rear end of the second side wall surface 1122 and the rear end of the third side wall surface 1132, the stressed conductive terminals 200 can slightly retreat, so as to disperse the external force and prevent the deformation.

In an embodiment, there is a distance L3 between the holding part 250 and the first rear wall surface 1113 and the third rear wall surface 1133, the distance L3 gradually decreases along the direction towards the free end of the holding part 250.

To facilitate the installation of the conductive terminals 200 from the top down into the insulation body 100, the second hole portion 112 and the third hole portion 113 are provided with chamfers on the upper surface of the insulation body 101. In this illustrated embodiment, he upper ends of the wall surfaces of the second hole portion 112 are provided with first chamfers 1124, and the upper ends of the wall surfaces of the third hole portion 113 are provided with second chamfers 1134.

The insulation body 100 is also provided with a supporting part 120 extending from the second rear wall surface 1123 to the first hole portion 111. The supporting part 120 butts against the main part 210 of the conductive terminals 200 to support the main part 210. Optionally, the contact surface between the supporting part 120 and the main part 210 does not cross the central line between the left and right sides of the main part 210. That is to say, the protrusion part from the second rear wall surface 1123 to the first hole portion 111 does not cross the central line between the left and right sides of the main part 210.

Referring back to FIG. 1, the supporting part 120 includes a columnar part 121 extending out of the upper surface 101 of the insulation body 100, and the cross section of the columnar part 121 gradually decreases from the bottom to the top. When the electrical connector 10 is in contact with the chip module, the columnar part 121 can support the chip module to prevent the chip module from being over pressed. In this illustrated embodiments, the columnar part 121 is a trapezoidal column.

In alternative embodiments, the supporting part 120 may not extend out of the upper surface 101 of the insulation body, for example, the upper surface of the supporting part 120 is flush with the upper surface 101 of the insulation body 100, or is lower than the upper surface 101 of the insulation body 100, all these arrangements can also support the main part 210.

The electrical connector 10 includes an insulation body 100 and the conductive terminals 200 positioned in the insulation body 100, the insulation body 100 includes the receiving holes 110; each of the receiving holes 110 includes the first hole portion 111, the second hole portion 112 and the third hole portion 113; for each receiving hole 110, the second hole portion 112 and the third hole portion 113 are located at two opposite sides of the first hole portion 111, and both communicate with the first hole portion 111; and the second hole portion 112 is obliquely positioned relative to the X axis and the Y axis of the insulation body 100; in addition, the distance L1 between the front end of the second side wall surface 1122 and the front end of the third side wall surface 1132 is less than the distance L2 between the rear end of the second side wall surface 1122 and the rear end of the third side wall surface 1132, such that the conductive terminals 200 can be steadily fixed in the insulation body 100, preventing the deformation of the conductive terminals 200 after being stressed.

Figure 10:
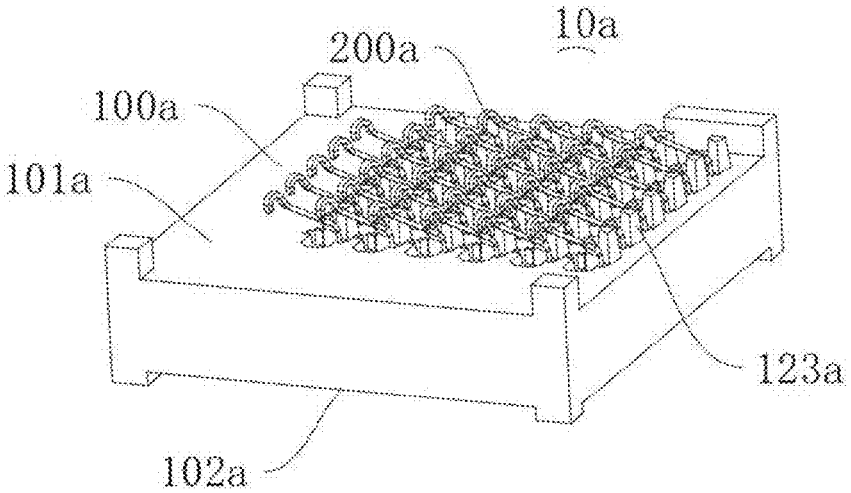
FIG. 10 is a stereogram of an electrical connector in accordance with another embodiment of the present disclosure.

According to another embodiment of the disclosure, as shown in FIG. 10, an electrical connector for electrically connecting a chip module (not shown) to a printed circuit board (not shown) is provided. The electrical connector 10*a* includes an insulation body 100*a* and a plurality of conductive terminals 200*a* positioned in the insulation body 100*a*; the insulation body 100*a* includes an upper surface 101*a* and a lower surface 102*a* opposite to the upper surface 101*a*; when the electrical connector 10*a* is connected to a chip module, the upper surface 101*a* is closer to the chip module than the lower surface 102*a*.

Figure 11:
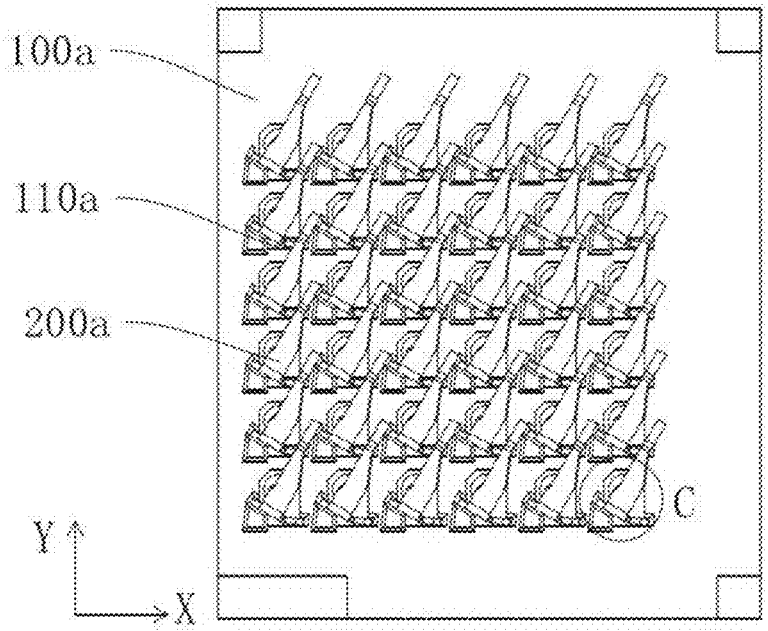
FIG. 11 is a top view of the electrical connector shown in FIG. 10.

Referring also to FIG. 11, the insulation body 100*a* defines a plurality of receiving holes 110*a*; the receiving holes 110*a* are arranged in the insulation body 100*a* in a grid of M rows×N columns; in this embodiment, the rows are arranged along the X axis of the insulation body 100*a*, and the columns are arranged along the Y axis of the insulation body 100*a*. Each receiving hole 110*a* accommodates a corresponding one of the conductive terminals 200*a*.

Figure 12:
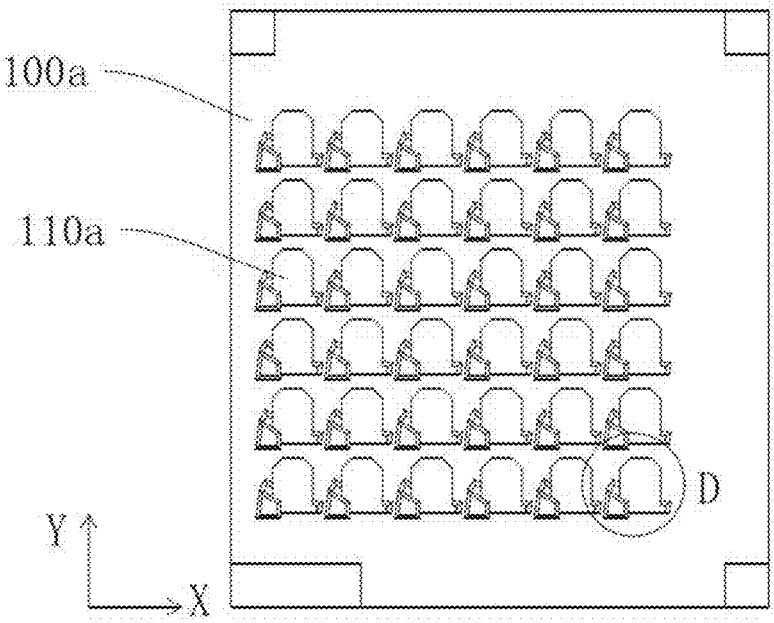
FIG. 12 is a top view of an insulation body of the electrical connector shown in FIG. 10.
Figure 13:
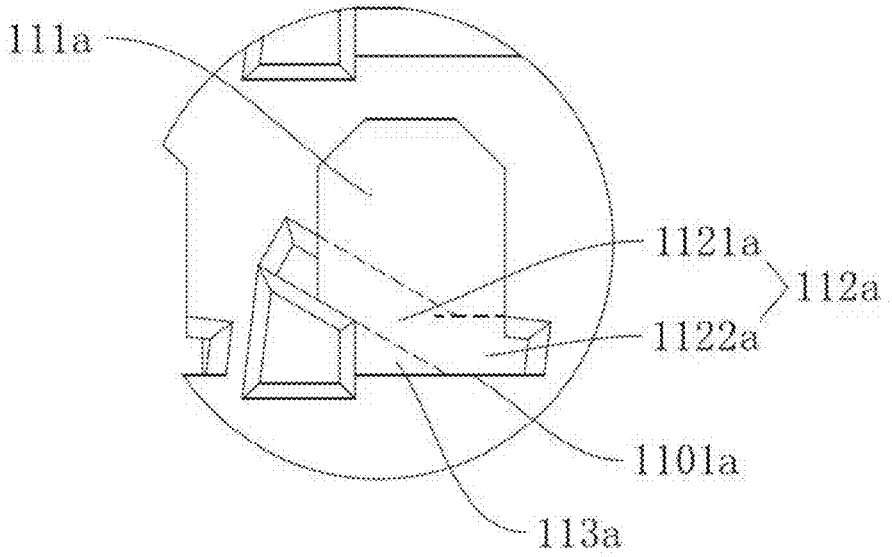
FIG. 13 is a local enlarged view of part D of the insulation body shown in FIG. 12.

Referring to FIG. 12 and FIG. 13, each of the receiving holes 110*a* includes a plurality of inner side surfaces, and one of the inner side surfaces 1101*a* is parallel to the X axis of the insulation body 100*a*. Each of the receiving holes 110*a* includes a first hole portion 111*a*, a second hole portion 112*a* and a third hole portion 113*a*; both the first hole portion 111*a* and the third hole portion 113*a* communicate with the second hole portion 112*a*; the second hole portion 112*a* includes a lateral hole portion 1121*a* and a horizontal hole portion 1122*a*. The lateral hole portion 1121*a* is obliquely positioned relative to the first hole portion 111*a*. The horizontal hole portion 1122*a* is positioned along the X axis of the insulation body 100*a*.

Figure 14:
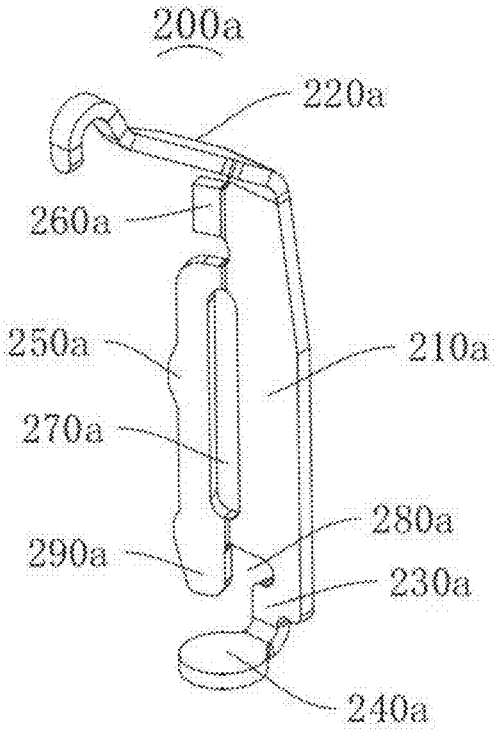
FIG. 14 is a stereogram of a conductive terminal of the electrical connector shown in FIG. 10.

As shown in FIG. 14, each of the conductive terminals 200*a* includes a tabulate main part 210*a*, an elastic arm 220*a* and a connection part 230*a*. The elastic arm 220*a* is an extension of an upper part of the main part 210*a*. The connection part 230*a* is an extension of a lower part of the main part 210*a*. The elastic arm 220*a* has good elasticity and extends out of the insulation body 100*a*, the connection part 230*a* is connected to a welding part 240*a*, the welding part 240*a* is bent at an angle of approximately ninety degrees with respect to the main part 210*a*, so that the conductive terminal 200*a* is welded to a printed circuit board through a solder.

The conductive terminal 200*a* further includes a holding part 250*a* which is an extension of a side part of the main part 210*a*; one end of the holding part 250*a* is a fixed end connecting the holding part 250*a* and the main part 210*a*, and the other end thereof is a free end.

In some embodiments, the conductive terminals 200*a* further include a solder part 260*a* which is an extension of the side part of the main part 210*a*; the solder part 260*a* and the holding part 250*a* are located on the same side of the main part 210*a*, the solder part 260*a* is located above the holding part 250*a*, and is positioned in the same plane as the holding part 250*a*.

Figure 15:
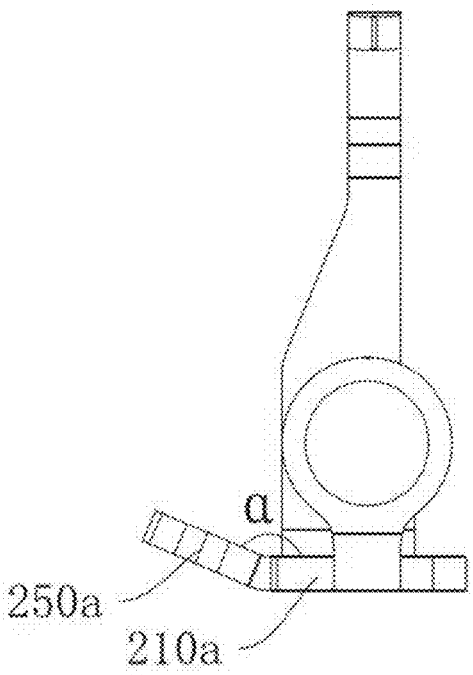
FIG. 15 is a bottom view of the conductive terminal shown in FIG. 14.

As shown in FIG. 15, an included angle $\alpha$ between the holding part 250*a* and the main part 210*a* ranges from 155° to 160°.

A deformed groove 270*a* is positioned between the main part 210*a* and the holding part 250*a*. The deformed groove 270*a* is a closed structure, and at least one in number. The deformed groove 270*a* is compression resistant, and when the conductive terminals 200*a* are mounted into the receiving holes 110*a* of the insulation body 100*a*, the holding part 250*a* is forced to squeeze the deformed groove 270*a*, so that the force apportioned on the main part 210*a* is less, the conductive terminals 200*a* are not easily deformed, thus reducing the defective rate of the conductive terminals 200*a* after the assembly.

The lower part of the connection part 230*a* is connected to the welding part 240*a*, the upper part of connection part 230*a* and the main part 210*a* form a separation slot 280*a*, and the deformed groove 270*a* is positioned above the separation slot 280*a*.

In some embodiments, the lower part of the holding part 250*a* extends downwards to form an extension 290*a*, which is positioned at the side of the separation slot 280*a*. During mounting the conductive terminals 200*a* into the insulation body 100*a*, the extension 290*a* can balance the stress of the main part 210*a*, which is conducive to securing and stabilizing the conductive terminals 200*a*, thus reducing the defective rate after the assembly.

Figure 16:
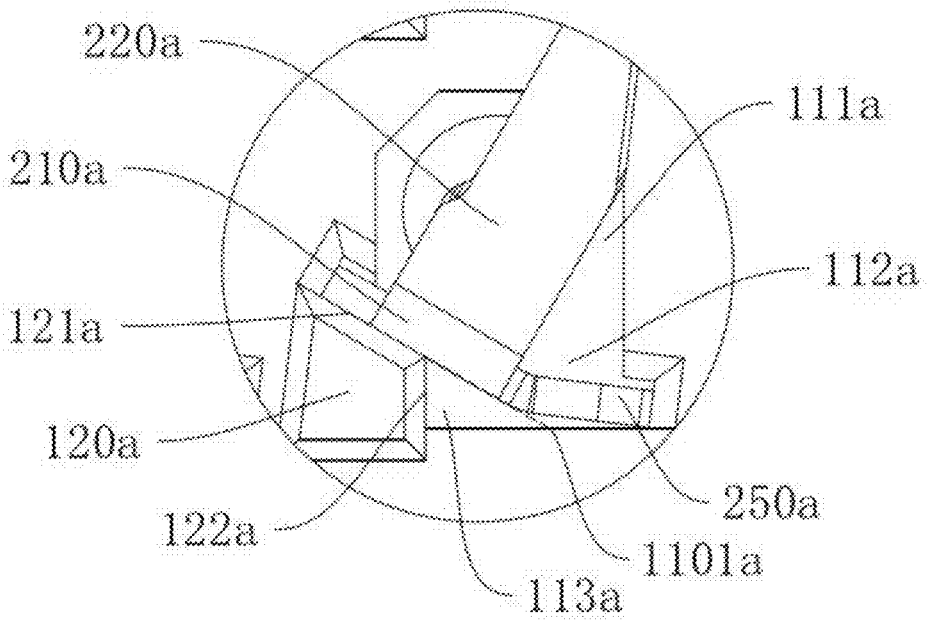
FIG. 16 is a local enlarged view of part C of the electrical connector shown in FIG. 11.

Referring to FIG. 16, both the main part 210*a* and the holding part 250*a* are embedded in the second hole portion 112*a*, and are obliquely positioned relative to the X axis of the insulation body 100*a*; the first hole portion 111*a* and the third hole portion 113*a* are located at two opposite sides of the main part 210*a*, and at least part of the elastic arm 220*a* is located above the first hole portion 111*a*.

As an exemplary embodiment, assume the extension direction of the elastic arm 220*a* is considered as the forward direction, the first hole portion 111*a* is located on the front side of the main part 210*a*, the third holding hole 113*a* is located on the back side of the main part 210*a*, and the elastic arm 220*a* may be partially or completely located above the first hole portion 111*a*. When the chip module is electrically connected to the conductive terminal 200*a* of the electrical connector 10 by pressing, after the elastic arm 220*a* of the conductive terminal 200*a* is stressed, the main part 210*a* and the holding part 250*a* are obliquely positioned relative to the X axis of the insulation body 100*a*, thus preventing the displacement of the conductive terminal 200*a*.

There is a space between the holding part 250*a* and the inner side surfaces 1101*a*, and the space gradually decreases along the direction towards the free end of the holding part 250*a*.

The insulation body 100*a* is also provided with a supporting part 120*a* which is positioned at one side of the main part 210*a* for supporting the main part 210*a*. The supporting part 120*a* and the third hole portion 113*a* are positioned at the same side of the main part 210*a*.

The supporting part 120*a* includes a first side 121*a* facing the second hole portion 112*a* and a second side 122*a* facing the third hole portion 113*a*; the first side 121*a* contacts with the main part 210*a*; the first side 121*a* does not cross the central line between the left and right sides of the main part 210*a*; the extension side of the first side 121*a*, the second side 122*a*, and the inner side surfaces 1101*a* parallel to the X axis of the insulation body 100*a* are cooperatively enclosed to form the third hole portion 113*a*.

In some embodiments, the third hole portion 113*a* is a triangular column.

Referring back to FIG. 10, the supporting part 120*a* further includes a columnar part 123*a* extending out of the upper surface 101*a* of the insulation body 100*a*, and the cross section of the columnar part 123*a* gradually decreases from the bottom to the top. When the electrical connector 10*a* is in contact with the chip module, the columnar part 123*a* can support the chip module to prevent the chip module from being over pressed. In the illustrated embodiment, the columnar part 123*a* is a trapezoidal column.

In alternative embodiments, the supporting part 120*a* may not extend out of the upper surface 101*a* of the insulation body 100*a*, for example, the upper surface of the supporting part 120*a* is flush with the upper surface 101*a* of the insulation body 100*a*, or is lower than the upper surface

101*a* of the insulation body 100*a*, all these arrangements can also support the main part 210*a*.

The electrical connector 10*a* includes an insulation body 100*a* and the conductive terminals 200*a* positioned in the insulation body 100*a*; the insulation body 100*a* includes the receiving holes 110*a*; each of the receiving holes 110*a* includes the first hole portion 111*a*, the second hole portion 112*a* and the third hole portion 113*a*; the lateral hole portion 1121*a* is obliquely positioned relative to the first hole portion 111*a*, and the horizontal hole portion 1122*a* is positioned along the X axis of the insulation body 100*a*; both the main part 210*a* and the holding part 250*a* of the conductive terminals 200*a* are embedded in the second hole portion 112*a*, and are obliquely positioned relative to the X axis of the insulation body 100*a*; the first hole portion 111*a* and the third hole portion 113*a* are located at two opposite sides of the main part 210*a*, and at least part of the elastic arm 220*a* is located above the first hole portion 111*a*, such that the conductive terminals 200*a* can be steadily fixed in the insulation body 100*a*, preventing the deformation of the conductive terminals 200*a* after being stressed.

Finally it shall be noted that, the above embodiments are only used to describe but not to limit the technical solutions of the present disclosure; and within the concept of the present disclosure, technical features of the above embodiments or different embodiments may also be combined with each other, the steps may be implemented in an arbitrary order, and many other variations in different aspects of the present disclosure described above are possible although, for purpose of simplicity, they are not provided in the details. Although the present disclosure has been detailed with reference to the above embodiments, those of ordinary skill in the art shall appreciate that modifications can still be made to the technical solutions disclosed in the above embodiments or equivalent substations may be made to some of the technical features, and the corresponding technical solutions will not depart from the scope of the present disclosure due to such modifications or substations.

What is claimed is:

1. An electrical connector, comprising: an insulation body and a plurality of conductive terminals positioned in the insulation body;

wherein:

the insulation body defines a plurality of receiving holes corresponding to the conductive terminals, respectively; each of the receiving holes comprises a first hole portion, a second hole portion and a third hole portion; first hole portions of the receiving holes are distributed in parallel along the X axis of the insulation body; for each receiving hole, the second hole portion and the third hole portion are located at two opposite sides of the first hole portion, and both communicate with the first hole portion; and the second hole portion is obliquely positioned relative to the X axis and the Y axis of the insulation body;

the first hole portion comprises a first front wall surface, a first side wall surface and a first rear wall surface; the second hole portion comprises a second front wall surface, a second side wall surface and a second rear wall surface; and the third hole portion comprises a third front wall surface, a third side wall surface and a third rear wall surface;

each of the conductive terminals comprises a main part, an elastic arm, a connection part and a holding part, the elastic arm is an extension of an upper part of the main part, the connection part is an extension of a lower part of the main part, and the holding part is an extension of a side part of the main part; at least part of the main part is embedded in the second hole portion, at least part of the holding part is embedded in the third hole portion, both the main part and the holding part are not parallel to the X axis and the Y axis of the insulation body; and a distance L1 between a front end of the second side wall surface and a front end of the third side wall surface is less than a distance L2 between a rear end of the second side wall surface and a rear end of the third side wall surface.

2. The electrical connector according to claim 1, wherein, the first rear wall surface of the first hole portion is parallel to the X axis of the insulation body; and the third rear wall surface of the third hole portion and the first rear wall surface share a common wall surface.

3. The electrical connector according to claim 1, wherein, a distance L3 is positioned between the holding part and the first rear wall surface and the third rear wall surface, and the distance L3 gradually decreases along the direction towards a free end of the holding part.

4. The electrical connector according to claim 1, wherein, a width of the third hole portion gradually increases along the direction towards the first hole portion, and the third front wall surface is not parallel to the third rear wall surface.

5. The electrical connector according to claim 1, wherein, the third side wall surface and the third rear wall surface of the third hole portion form a non-right angle.

6. The electrical connector according to claim 1, wherein, the second side wall surface is obliquely positioned relative to the X axis and the Y axis of the insulation body, and the second front wall surface is parallel to the second rear wall surface.

7. The electrical connector according to claim 1, wherein, an inclination angle of the second side wall surface relative to the X axis of the insulation body is $\theta$, an angle $\beta$ formed by the third side wall surface and the third rear wall surface is less than $(180°-\theta)$ and unequal to 90°.

8. The electrical connector according to claim 1, wherein, the second hole portion and the third hole portion each comprise chamfers on an upper surface of the insulation body.

9. The electrical connector according to claim 1, wherein, the insulation body comprises a supporting part extending from the second rear wall surface towards the first hole portion; and the supporting part butts against the main part of the conductive terminals.

10. The electrical connector according to claim 9, wherein, the supporting part comprises a columnar part extending out of an upper surface of the insulation body, and a cross section of the columnar part gradually decreases from a bottom of the columnar part to a top of the columnar part.

11. An electrical connector, comprising: an insulation body and a plurality of conductive terminals positioned in the insulation body;

wherein:

the insulation body defines a plurality of receiving holes corresponding to the conductive terminals, respectively; each of the receiving holes comprises a plurality of inner side surfaces; each of the receiving holes comprises a first hole portion, a second hole portion and a third hole portion; for each receiving hole, the first hole portion and the third hole portion communicate with the second hole portion; the second hole portion comprises a lateral hole portion and a horizontal hole portion, the lateral hole portion is obliquely positioned relative to the first hole portion, and the horizontal hole portion is positioned along the X axis of the insulation body;

each of the conductive terminals comprises a main part, an elastic arm, a connection part and a holding part, the elastic arm is an extension of an upper part of the main part, the connection part is an extension of a lower part of the main part, and the holding part is an extension of a side part of the main part; and both the main part and the holding part are embedded in the second hole portion, and are obliquely positioned relative to the X axis of the insulation body; the first hole portion and the third hole portion are located at two opposite sides of the main part, and at least part of the elastic arm is located above the first hole portion.

12. The electrical connector according to claim 11, wherein, the conductive terminals further comprise a solder part which is an extension of a side part of the main part and is located above the holding part; the solder part and the holding part are positioned in a same plane.

13. The electrical connector according to claim 11, wherein, an included angle $\alpha$ between the holding part and the main part ranges from 155° to 160°.

14. The electrical connector according to claim 11, wherein, a deformed groove with a closed structure is positioned between the main part and the holding part.

15. The electrical connector according to claim 11, wherein, one of the inner side surfaces is parallel to the X axis of the insulation body; a space is positioned between the holding part and the inner side surfaces, and the space gradually decreases along the direction towards a free end of the holding part.

16. The electrical connector according to claim 11, wherein, the insulation body comprises a supporting part which is positioned at one side of the main part for supporting the main part; and the supporting part and the third hole portion are positioned at the same side of the main part.

17. The electrical connector according to claim 16, wherein, the supporting part comprises a first side facing the second hole portion and a second side facing the third hole portion; the first side contacts the main part;

an extension side of the first side, the second side, and the inner side surfaces parallel to the X axis of the insulation body are cooperatively enclosed to form the third hole portion.

18. The electrical connector according to claim 17, wherein, the third hole portion is a triangular column.

19. The electrical connector according to claim 17, wherein, the first side does not cross a central line between left and right sides of the main part.

20. The electrical connector according to claim 17, wherein, the supporting part further comprises a columnar part extending out of the upper surface of the insulation body, and a cross section of the columnar part gradually decreases from a bottom of the columnar part to a top of the columnar part.

* * * * *